United States Patent [19]

Nakanishi

[11] 4,388,866

[45] Jun. 21, 1983

[54] METHOD OF PRINTING

[75] Inventor: Motoyasu Nakanishi, Shimizushi, Japan

[73] Assignees: Suzuki Sogyo Kabushiki Kaisha; Kabushiki Kaisha Cubic Engineering, both of Shizuokaken, Japan

[21] Appl. No.: 228,702

[22] Filed: Jan. 26, 1981

[51] Int. Cl.[3] ..... B44C 1/16

[52] U.S. Cl. ..... 101/426; 101/35; 101/368; 101/379; 156/384

[58] Field of Search ..... 101/35, 368, 379, 426; 156/384, 230, 540, 581

[56] References Cited

U.S. PATENT DOCUMENTS

| | | | |
|---|---|---|---|
| 453,772 | 6/1891 | Harper | 101/379 |
| 522,567 | 7/1894 | Winkel | 101/368 |
| 2,166,138 | 7/1939 | Gundlach | 101/35 |
| 2,810,916 | 10/1957 | Scott | 156/540 |
| 3,025,208 | 3/1962 | Geiger | 156/581 |
| 4,010,057 | 3/1977 | Nakanishi | 156/384 |
| 4,229,239 | 11/1980 | Arai et al. | 156/230 |
| 4,299,644 | 11/1981 | Arnold | 156/230 |
| 4,314,814 | 2/1982 | Deroode | 156/540 |

*Primary Examiner*—Richard J. Apley
*Assistant Examiner*—David J. Isabella
*Attorney, Agent, or Firm*—Wenderoth, Lind & Ponack

[57] ABSTRACT

A method of printing which comprises placing a pattern for printing on a deformable layer consisting of an assemblage of a plurality of fine straight pins which are arranged in parallel in high density and having an impression surface for printing which is formed by the ends of the pins, and impressing a material to be printed onto the pattern to relatively immerse the material to be printed into the deformable layer so that the pattern is closely adhered to the material to be printed.

11 Claims, 21 Drawing Figures

METHOD OF PRINTING

BACKGROUND OF THE INVENTION

The present invention relates to a method of printing on a curved surface of a material to be printed. This kind of conventional printing method, as described in the specification of the U.S. Pat. No. 4,010,057, depends on a technique by which an inflatable film on which a transcription pattern is printed in advance is kept afloat on water, to be expanded and impressed by a material to be printed to be immersed into water, and the film is adhered to the material to be printed by virtue of water pressure while the film is extended.

However, the conventional method is disadvantageous in that it is difficult to supply the film since it should be kept stationary on the water surface, a favorable print cannot be obtained if the timing of impression of the material to be printed is delayed since the film begins to extend and expand as soon as it contacts water, it is troublesome to impress the material to be printed against the film, and the printing of the pattern on the specified position of the material to be printed is difficult.

SUMMARY OF THE INVENTION

The present invention provides a method of printing which comprises providing a deformable layer which consists of an assemblage of straight pins arranged in parallel in high density and which has one end of the impression surface formed by an assemblage of these pins; extending a printing film for transcription, which is made of an extendible film and is provided with a transcription surface on which a transcription pattern is preprinted, on the impression surface of the deformable layer so that the rear of the transcription surface contacts the deformable layer; relatively immersing a material to be printed into the deformable layer to cause the transcription surface of the print film to contact the material to be printed; and depressing those of said pins which contact the material to be printed by the material to be printed to cause the pins to be retracted so that the printing film is forced to closely contact the material to be printed and the transcription pattern is transcribed onto the material to be printed.

Furthermore, the present invention provides a method of printing to cover the material to be printed with an extendible film made of a thermally fusible material. According to this method, the film need not be removed since at least one of the material to be printed and the deformable layer is heated to make a covering film adhere to the material to be printed.

The present invention also provides a method of printing in which the printing film is adhered to the material to be printed with an adhesive layer interposed between them. This method is advantageous in that the transparency of the printing film is not impaired if a transparent film is used since the printing film can be adhered to the material to be printed without fusing printing film to the material to be printed.

Moreover, the present invention provides a method of printing adapted to uniformly distribute the pressure of the deformable layer applied to the transcription film or the covering film through a sheet layer made of a plastically deformable material such as, for example, silicon rubber, interposed between the transcription film or the printing film and the deformable layer. According to this method, the printing film can be protected from damage since the end faces of the straight pins which form the impression surface of the deformable layer do not directly contact the film.

Moreover, the present invention provides a method of printing directly on a curved surface of the material to be printed with the printing pattern by directly printing the pattern in the impression surface of the deformable layer. According to this method, since the printing film is not required, the method is inexpensive.

DETAILED DESCRIPTION OF THE INVENTION

Figure 1:
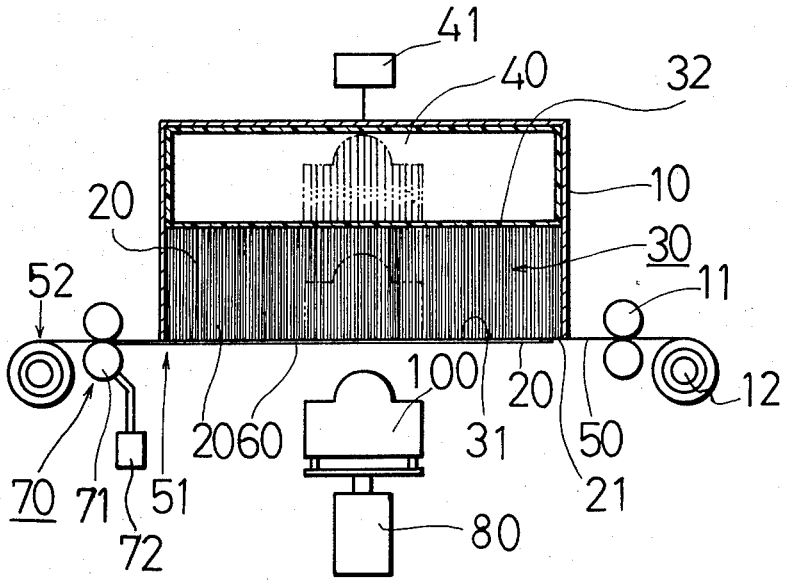
FIGS. 1 to 3 are respectively a cross sectional side view illustrating an embodiment of the printing tub to be employed in accordance with the present invention.

Referring to FIG. 1, there is shown an assemblage of a plurality of thin straight pins 20 which are arranged in parallel in high density in printing tub 10 to form deformable layer 30.

Said deformable layer 30 has impression surface 31 formed by the assemblage of one end, for example, the lower ends, of said straight pins 20 as the impression surface for printing film 50, wherein said straight pins 20 are freely slidable in their axial direction.

Said straight pins 20 are provided with resistant force providing means which provides a certain specified force against the sliding motion of the straight pins. The pins are given the resistant force by this means at least during their retracting movement from the impression surface 31 toward the inside of the deformable layer.

The resistant force set by said resistant force providing means differs with the type of embodiment of the present invention; for example, the resistant force is relatively large in case of the pressure sensing type transcription as compared to other means which can be employed, and can be as large as to maintain close adhesion of the straight pins 20 to the material to be printed in case of a hot stamp or dissolving type transcription. Accordingly, the resistant force providing means can provide the resistant force for individual straight pins 20 or can provide the resistant force for the deformable layer 30 as a whole.

Figure 7:
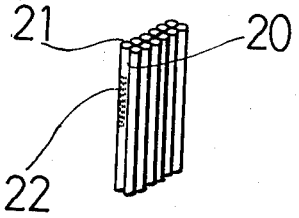
FIG. 7 is a perspective view illustrating an embodiment of the straight pins to be employed in the method of printing in accordance with the present invention.
Figure 8:
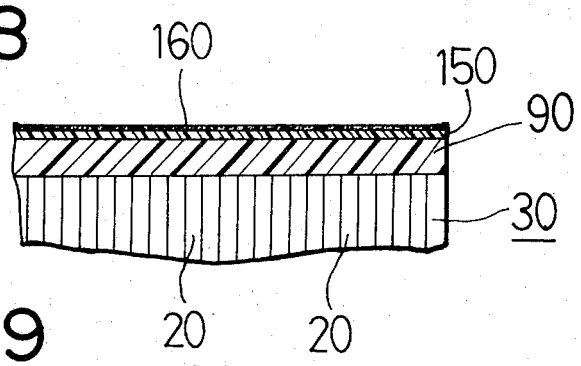
FIG. 8 illustrates another embodiment of the method of printing in accordance with the present invention.

As an example of the former, interacting friction force of individual straight pins 20 can be utilized. In this case, the friction surfaces 22 which provide frictional resistance can be formed on the lengthwise surfaces of the straight pins as shown in FIG. 7 to cause the resistant force to be produced when the straight pins 20 are retracted. This arrangement is effective, depending on the particular application thereof.

As said resistant force providing means, the deformable layer 30 is set so that the impression surface 31 is face down and the weight of the straight pins 20 acts as the resistant force. In this case, the straight pins 20 should be prevented from sliding completely out of the apparatus.

Figure 2:
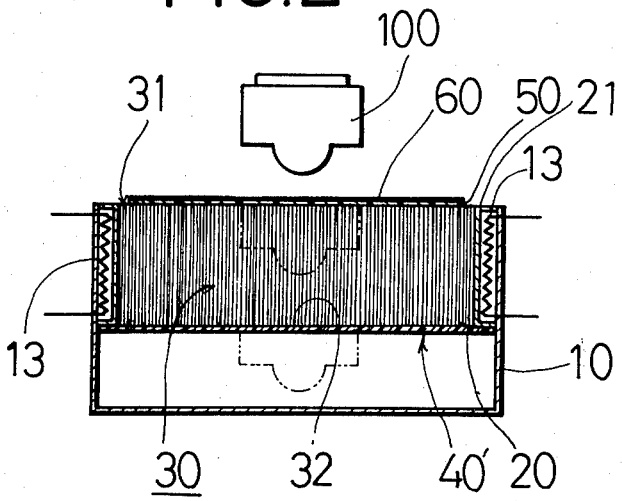

Such construction can be considered that elastic film 40' made of rubber or the like is extended on the rear surface 32 at the rear side of the impression surface 31 of the deformable layer 30 as shown in FIG. 2, and this elastic film 40' provides a repulsive force against deformation of the deformable layer 30 when the impression surface 31 is face up. However, a preferable construction is such that a cushion layer 40 such as an air cushion or sponge cushion layer, or a silicon rubber layer is formed on the rear surface 32 of the deformable layer 30 as shown in FIG. 1. The cushion layer 40 is preferably provided with a vibratory means 41 such as, for example, an ultrasonic oscillator or a vibrator.

The construction as described is advantageous in that when the vibratory means is vibrated in the axial direction of straight pins 20, immersion of material 100, to be printed, into the deformable layer 30, which is described later, can be facilitated, and the deformable layer 30 is automatically restored to the initial position owing to the recovering force of the air cushion 40 after the material 100 has been removed.

The printing film 50 made of an extendible film is supplied to said printing tub 10. A transcription pattern 60 such as, for example, wood grain pattern or cloud pattern is preprinted on the printing film 50 to form transcription surface 51.

This printing film 50 is supplied by keeping its rear surface 52, in the area of the transcription surface 51, in contact with the deformable layer 30, and keeping film 50 stationary on the impression surface 31 of the deformable layer 30. Said transcription film 50 can be cut in advance in a specified size but, in case of the embodiment shown in FIG. 1, it is made as a series of film.

The transcription pattern 60 is printed on said printing film 50 at printing station 70 provided in the vicinity of the printing tub 10 as shown in FIG. 1, or at a different place. If the transcription pattern 60 is printed on the printing film 50 shortly before entering the printing tub 10, the transcription pattern is still wet when it is fed into the printing tub 10 and therefore this printing method is advantageous in facilitating the transcription effect.

If the transcription pattern is printed at a separate place, it can be printed in multiple colors, and a solvent for dissolving ink printed upon transcription should be sprayed or applied onto the ink to activate the transcription pattern 60 since the transcription pattern 60 is dried.

This printing station 70 contains printing roller 71 and ink supply tank 72 and the printing film 50 is printed by the printing roller 71 as in case of the conventional printing apparatus.

An elevating means 80 for elevating the material 100 to be printed is provided just below said printing tub 10 to hold the material 100, impress it onto the transcription surface 51 of the printing film 50 and subsequently depress it against the deformable layer 30. The material 100 is lowered by the elevating means 80 after transcription and is separated from the deformable layer 30.

This elevating means 80 and the printing tub 10 can contact and part from each other at relative positions; accordingly, the elevating means 80 can be fixed and the printing tub 10 can be elevated or both the elevating means 80 and the printing tub 10 can be moved to contact and part from each other. Moreover, the elevating means 80 and the printing tub 10 can be relatively alternated, for example, it is convenient for mass printing to provide the elevating means 80 on a trolley conveyor to convey the material 100 to a demounting apparatus after transcription.

Said printing film 50 can be made of a material which is extendible at the time of transcription; for example, an elastic film or an expandable film such as a thin rubber strip or a thermo-deformable film, or a film which is softened by a solvent can be used.

In case the printing film 50 is made of an elastic film, a cleaner 11 is provided following the printing tub 10 to clean the transcription surface 51 and the printing film 50 can be wound up by winding-up means 12 after cleaning.

In case the printing film 50 is made of a thermo-deformable film, the printing film 50 can be given an extendibility by heating the deformable layer 30 in the printing tub 10 with heater 13 as shown in FIG. 2.

In case the printing film 50 is an expandable film made of, for example, polyvinyl alcohol or methyl cellulose, a water supply and discharge system 14 as a means for expanding the printing film 50 can be provided wherein, for example, pump P is adapted to raise the water level L in the printing tub 10 to make the printing film 50 absorb water when the printing film 50 is extended over the deformable layer 30, and lower the water level to prevent spontaneous extension of the printing film 50 after expansion of the printing film 50. In case said printing film 50 can be made extendible with a solvent such as, for example, butyl rubber or vinyl acetate, the solvent can be sprayed onto the printing film 50 which is extended over the deformable layer 30.

Said printing film 50 is removed in most cases from the material 100 after transcription by using an exfoliating or dissolving means.

The transcription pattern 60 can be adhered to the material 100 to transcribe the transcription pattern 60 from the printing film 50 to the material 100. Transcription can be achieved by means of an impression force or other method, for example, a so-called hot stamping method for heating the transcription pattern 60.

Figure 3:
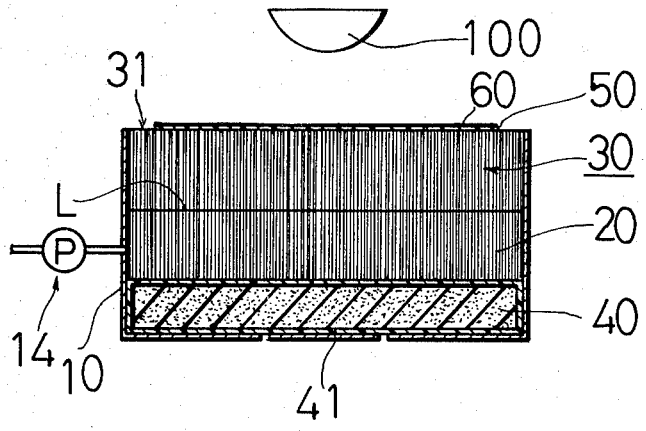

In the present invention as described above, the material 100 can be printed through the following processes when the printing tub 10 shown in FIG. 3 is used.

Figure 4A:
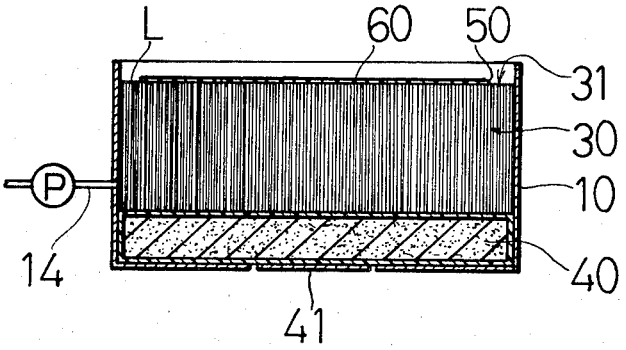
FIGS. 4*a* to 4*c* illustrate the steps of the method of printing in accordance with the present invention.
Figure 4B:
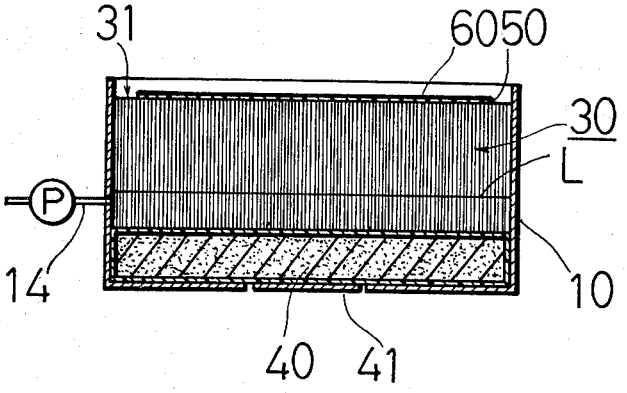

The printing film 50 stored in the printing tub 10 is expanded as a result of being soaked by water which entirely covers the deformable layer 30 as shown in FIG. 4A, to give the film 50 extendibility. The water level L is then lowered by the water supply and discharge system 14 as shown in FIG. 4B, thus maintaining the printing film 50 stationary without further spontaneous extension.

Figure 4C:
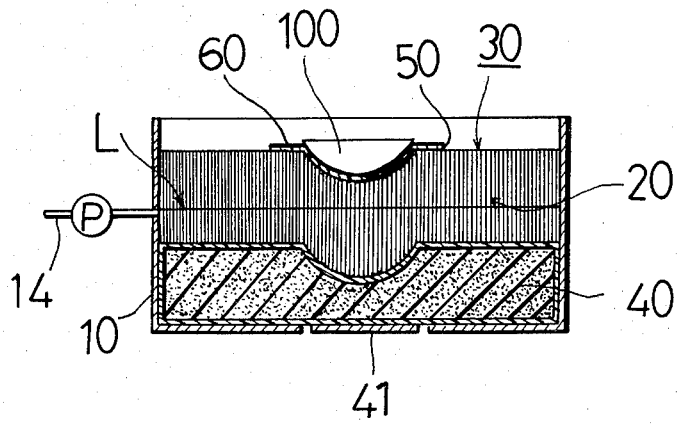

When the material 100 to be printed is lowered into the printing tub 10 under this condition as shown in FIG. 4C to contact the printing film 50, and is depressed down, the straight pins 20 which form the deformable layer retract while rubbing the surface of the material 100 to be printed to enable the material 100 to be immersed into the deformable layer 30.

In this case, the printing film 50 is impressed and rubbed against the surface of material 100 by the straight pins 20 of the deformable layer which are given a resistant force and can therefore be forced to closely contact and extend onto the surface of material 100, thereby transcribing transcription pattern 60 onto the material 100.

Accordingly, when the printing film 50 is removed from the material 100, the transcription pattern 60 remains on the surface of the material 100 and therefore the printing can be satisfactorily carried out even on a curved surface of the material 100.

In the above processes, a top coating will be required in some cases after the transcription pattern 60 has been printed on the material 100 since the printing film 50 is removed after printing.

The method shown in the second embodiment described below is effective in providing a top coat.

Figure 5A:
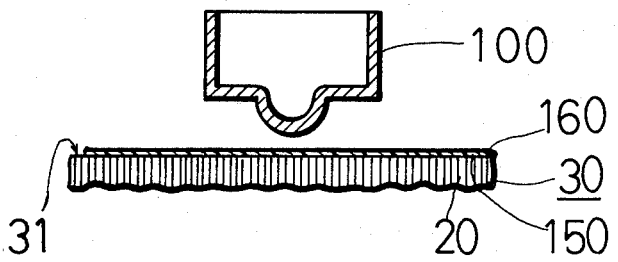
FIGS. 5*a* and 5*b* illustrate other steps of the method in accordance with the present invention.

This second embodiment utilizes the tub 10 shown in FIG. 2. This embodiment is characterized by using an extendible film made of thermo-melting resin shown in FIG. 5A as the printing film 150 on which a printing pattern 160 is provided at one of its front and rear surfaces, extending this printing film 150 in the printing tub 10 shown in FIG. 2, raising, by means of heater 13, the temperature of the deformable layer 30 of the printing tub 10 for which straight pins 20 having excellent heat conductivity are used, up to the melting temperature of the printing film 150, and immersing the material 100 into the deformable layer 30 while said layer 30 is being vibrated. The printing film 150 is made to closely contact the surface of the material 100 by the retracting straight pins 20 and is heated by the straight pins 20 to cause film 150 to be adhered to the material 100.

Figure 5B:
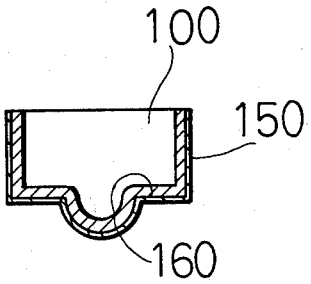

According to the second embodiment of the present invention, the material of the printing film 150 can form the outer surface of the printed material, since the surface of the material 100 to be printed can be covered with the printing film 150. Moreover, if the printing film 150 is made of a transparent material, the printing film 150 can be used as the top coat as shown in FIG. 5B by providing the printing pattern 160 on the internal surface, that is, the surface of the printing film 150 which contacts the material 100 to be printed.

In the second embodiment, the heating means for the deformable layer 30 can be the vibrating means 41, which can generate heat from its vibratory wave.

In this case, an advantage is that a separate heating means need not be provided. However, a heating means can be provided to heat the material 100 to be printed, in which case the effect of adhesion is improved since the temperature at the surface of the material 100 to be printed is increased.

The heating to raise the temperature of said deformable layer 30 and the material 100 to be printed can be carried out while the material 100 is being depressed into the deformable layer 30 or after the former has been depressed into the latter. However, since it is suitable to raise the temperature of the deformable layer 30 at all times, heating of layer 30 is generally carried out to raise the external surface temperature while the material 100 to be printed is kept immersed against the deformable layer 30 for a specified period of time.

In said second embodiment, the printing film 150 is thermally melted to adhere to the material 100 to be printed. In this case, the temperature should be relatively high because the melting of the printing film 150 is required.

The third embodiment is intended to eliminate such disadvantage. This embodiment is also intended to adhere the printing film 150 to the material 100 to be printed with an adhesive layer 151 formed on the internal surface of the printing film 150 as shown in FIG. 6A and FIG. 6B or on the surface of the material 100 to be printed.

The adhesive layer 151 of said printing film 150 can be of a thermo-melting type or a pressure sensitive type. In case of a thermo-melting type, it is desirable to select a material which is adhesive at a temperature lower than the fusing temperature of the covering film 150.

The thermo-melting or pressure sensitive type adhesive layer can be selected for said material 100 to be printed.

Figure 6A:
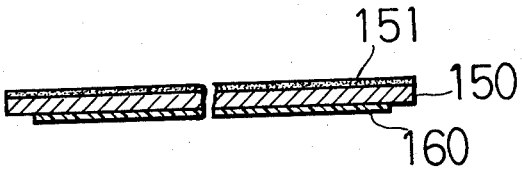
FIGS. 6*a* and 6*b* are respectively a magnified cross sectional view of a part of the film showing an embodiment of the printing film to be employed in the method of printing in accordance with the present invention.
Figure 6B:
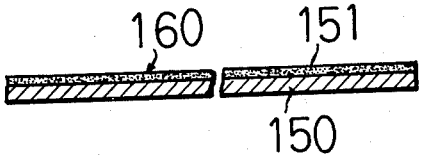

The adhesive layer 151 of said printing film 150 is formed by applying an adhesive agent to the printing film 150 as shown in FIG. 6A. In case the printing film 150 is transparent and the printing pattern 160 is printed entirely on the film surface which comes in contact with the material 100 to be printed, the printing pattern 160 can be printed with an adhesive type ink such as a thermally-soluble ink to form the adhesive layer as shown in FIG. 6B.

According to the third embodiment, the printing film 150 can be made of a material other than a thermo-melting material, and can be advantageously adhered to the material 100 without excessively melting the printing film 150, even if the printing film 150 is made of a thermo-melting material.

A sheet layer 90 made of a plastically deformable material such as silicon rubber can be interposed between said printing film 50 or 150 and the deformable layer 30 in the printing tub 10. Thus the pressure of the deformable layer 30 on the film 50 or 150 is uniformly distributed and the film 50 or 150 can be protected against damage due to the straight pins 20 since film 50 or 150 does not directly contact the straight pins 20.

The following describes the fourth embodiment of the embodiment of the method of printing according to the present invention with respect to FIGS. 9 to 13.

In the fourth embodiment, the printing film 50 or 150 is not used and the transcription pattern 180 is directly printed on the impression surface 131.

In FIGS. 9 to 13, the printing tub 10, deformable layer 30, material 100 to be printed, elastic film 40', and supporter or elevating means 80 are the same as described in the first embodiment.

Figure 9:
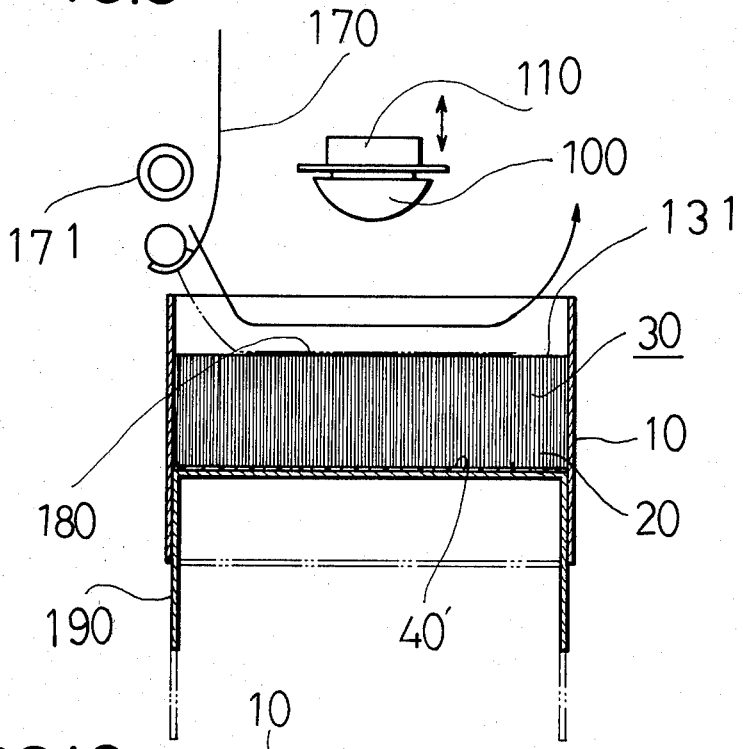
FIG. 9 is a cross sectional side view of the printing tub illustrating a further embodiment of the method in accordance with the present invention.
Figure 10:
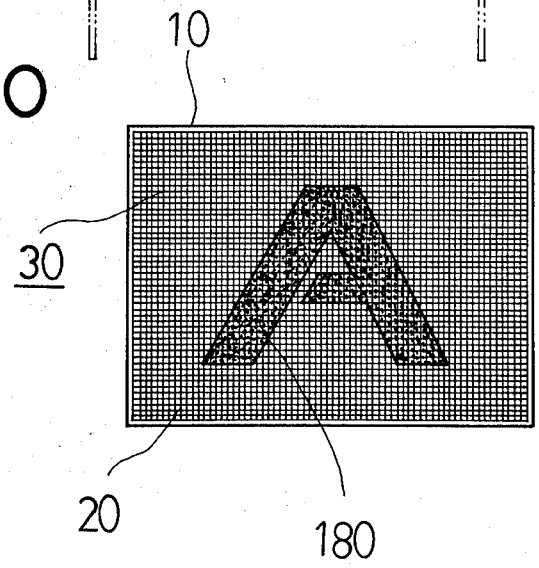
FIG. 10 is a plan view of the printing tub shown in FIG. 9.

In this embodiment, the cushion layer 40, as shown in FIG. 1, can be used in place of the elastic film 40' of FIG. 9. The force resisting movement of pins 20 can be provided by the interacting friction force of the pins 20 as described above for FIG. 7, without using the elastic layer 40' or the cushion layer 40.

In this embodiment, the transcription pattern 180 is directly printed onto the impression surface 131 of said deformable layer 30.

The means for printing this transcription pattern 180 is optional; for example, screen 170, as used in a screen printing method can be set on the impression surface 131 and ink roller 171 can be rolled over the screen 170 in the direction indicated by the arrow.

Figure 11:
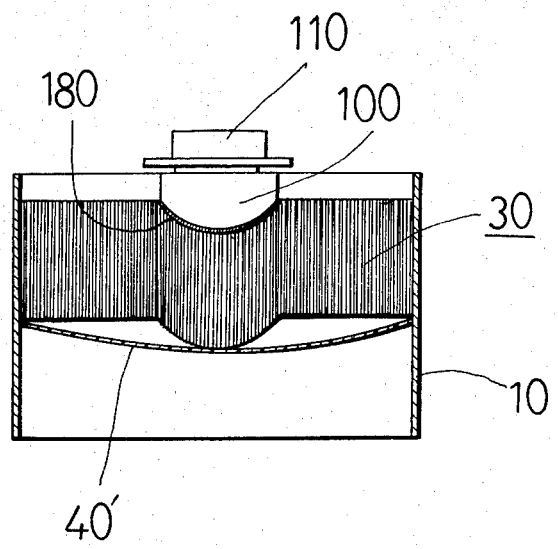
FIG. 11 is a cross sectional side view illustrating the position of the printing tub shown in FIG. 9 when the printing is carried out.

After the printing of said transcription pattern 180 is finished, the material 100 to be printed is impressed onto the impression surface 131 of said deformable layer 30 and immersed under pressure into the deformable layer 30 as shown in FIG. 11.

When the material 100 to be printed is thus immersed into the deformable layer 30, the impression surface 131 of the deformable layer 30 varies its shape along the curved surface of the material 100 and the transcription pattern 180 printed on the impression surface 131 is transcribed onto the outer surface of the material 100.

Figure 12:
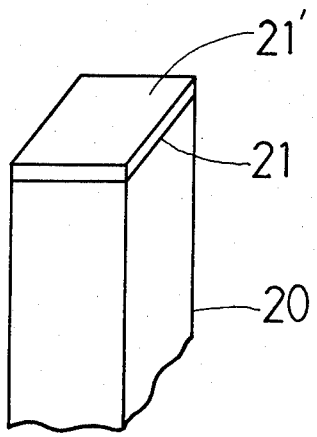
FIG. 12 is a perspective view illustrating the end part of a straight pin to be employed in the printing tub shown in FIG. 9.

To improve the transcription effect, the diameter of each straight pin 20 can be reduced or the end face 21 of the straight pin is formed with elastic piece 21' such as polyurethane as shown in FIG. 12 so that the end face 21 can closely contact to the outer surface of material 100 to be printed.

The method in accordance with the present invention can be adapted as described below.

The aligning frame 190, which fits the overall rear surface of the deformable layer 30 and prevents variation in the shape of the deformable layer 30 and maintains the impression surface 131 when the aligning frame contacts the straight pins 20 as shown in FIG. 9, can be provided on the rear surface of said deformable layer 30.

If this aligning frame 190 is moved in the printing tub 10 to contact the deformable layer 30 as shown with a solid line in FIG. 9 when the transcription pattern 180 is to be printed, and retracted as shown with a broken line in FIG. 9 when the transcription pattern is transcribed, the transcription pattern 180 can be clearly printed.

Since said transcription pattern 180 is prepared for each material 100 to be printed, it is preferable to remove the transcription pattern 180 after transcription onto a specific material 100 to be printed.

Figure 13:
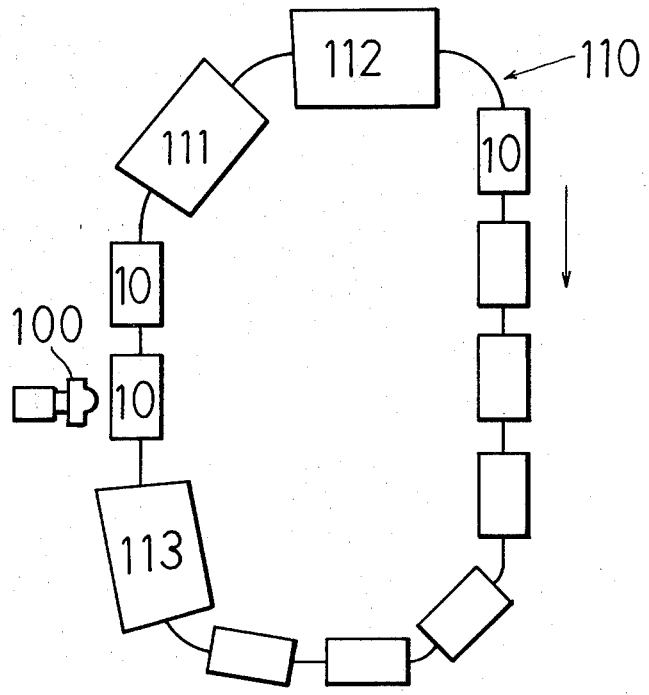
FIG. 13 is a block diagram of the printing system employing the printing tub shown in FIG. 9.

Therefore, the printing tub 10 can be cleaned after each transcription. If the transfer apparatus as shown in FIG. 13 is designed to circulate a plurality of printing tubs 10 which are moved to the printing station 113 through the cleaning station 111 and the drying station 112 after transcription, a continuous printing operation can be carried out.

One or both of said deformable layer 30 and said material 100 to be printed can be heated.

Thus clear printing can be done by using the transcription pattern 180 made of a thermo-dissolving ink.

Several screens of said transcription pattern 180 can be used individually to make a multi-colored pattern on the impression surface 131 before printing, or can be respectively transcribed several times onto said material 100 to carry out multi-color printing.

In all the embodiments of the present invention, the apparatus shown in FIG. 13 is convenient.

Said printing tub 10 is generally open in the vertical direction as shown in the embodiments. Depending on the particular application of the invention, printing tub 10 can be positioned so that it is open in the horizontal direction. This is advantageous in that the straight pins 20 do not slide completely out of the apparatus even though the resistant force of the straight pins 20 is small.

In said above embodiments, the straight pins 20 provide the resistant force arising from their frictional surfaces 22, or are supported by the elastic film 40' or the cushion layer 40. When the elastic film 40' is used, it is unavoidable that the elastic film 40' is partly detached from the rear surface of the deformable layer 30 as shown in FIG. 11. When the cushion layer 40 is used, as shown in FIG. 1, the cushion layer 40 cannot closely contact the material 100 if the material 100 has a complex shape.

Figure 14:
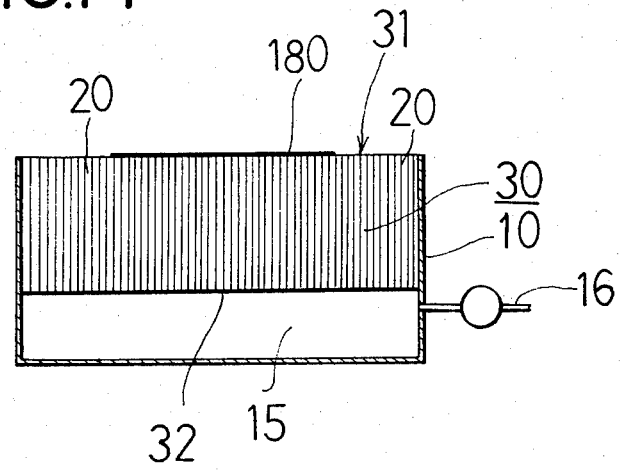
FIG. 14 is a cross sectional side view of the printing tub illustrating a further embodiment of the method of printing in accordance with the present invention.
Figure 15:
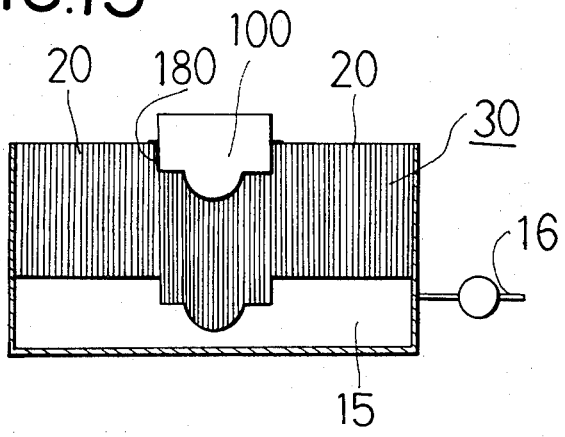
FIG. 15 is a cross sectional side view illustrating the position of the printing tub shown in FIG. 14 when the printing is carried out.

To overcome this disadvantage, referring to FIGS. 14 and 15, pneumatic pressure is applied to the rear surface 32 of the deformable layer 30.

This pneumatic pressure is obtained by feeding compressed air into cavity 15 formed behind the deformable layer 30 from air supply piping 16.

In this embodiment, when the material 100 to be printed is immersed under pressure into the deformable layer 30, the straight pins 20 retract against the pneumatic pressure as shown in FIG. 15 and are given uniform depressing force. The straight pins 20 retract individually whereby the impression surface 31 of the deformable layer 30 is deformed to be accurately profiled to the curved surface of the material 100 to be printed.

In said embodiments, the deformation of the impression surface 31 along the curved surface of material 100 to be printed is described. The material 100 to be printed can be immersed relatively into the impression surface 31 and accordingly, as shown in FIG. 16, the material 100 can be immersed into the deformable layer 30 as shown by the broken lines by moving the deformable layer 30 as a whole toward the material 100 to be printed.

Figure 16:
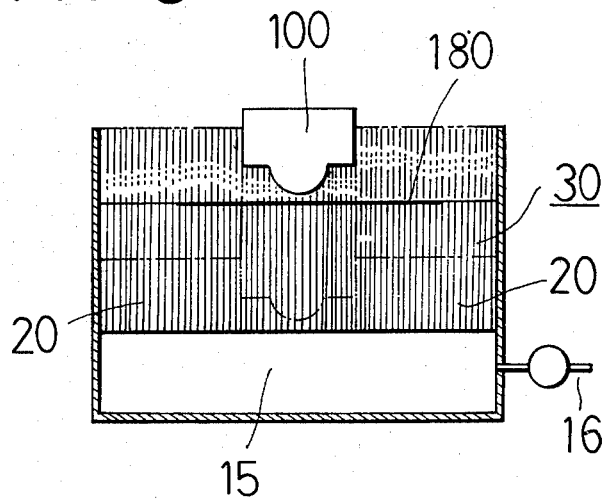
FIGS. 16 and 17 are respectively a cross sectional view of the printing tub illustrating a further embodiment of the method of printing in accordance with the present invention.
Figure 17:
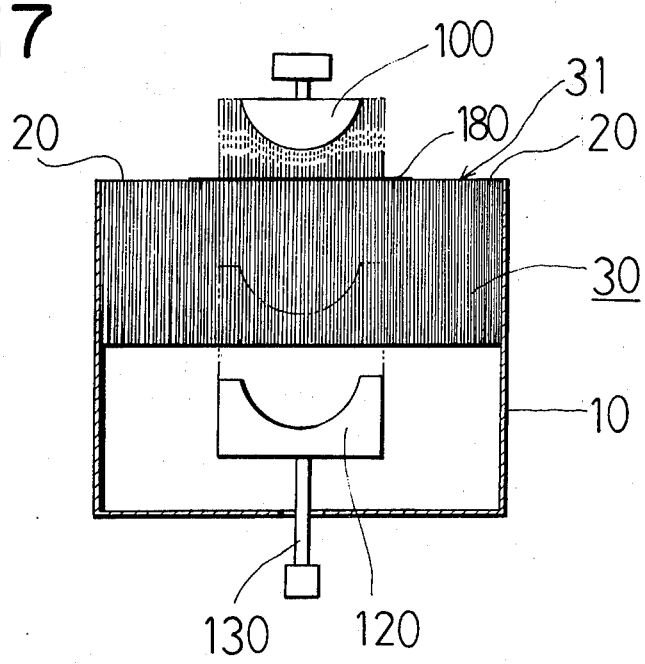

In this case, the pneumatic pressure in the cavity 15 can be increased by using said air supply piping 16 and the transcription pattern 180 is printed on the material 100 by raising the deformable layer 30 as shown in FIG. 16.

As a means to raise the deformable layer 30, mold 120 provided with a curved surface which fits the curved surface of the material 100 can be used. The curved surface of material 100 can be immersed into the deformable layer 30 by raising this mold 120 up to the position indicated by the broken lines with elevating means 130 such as, for example, an air cylinder.

The pattern 180 for printing is shown in FIGS. 14 to 17 as an embodiment of the transcription pattern. This pattern can also be the transcription pattern 60 provided on the printing film 50, for example as in FIG. 1, or the transcription pattern 160 provided on the printing film 150, for example as in FIG. 5A.

What is claimed is:

1. A method of printing a material to be printed, which comprises:

providing a deformable layer of an assemblage of straight pins arranged parallel to each other to form an impression surface at one end of said assemblage, said pins being provided in a density to exert pressure on an extendible printing film when said film is placed in contact with said impression surface of said deformable layer, placing said extendible printing film of a thermo-melting resin, having a pattern printed on said film, in contact with said impression surface of said deformable layer, heating at least one of said deformable layer and said material to be printed to melt said printing film, contacting said melted film with a surface of the said material to be printed under pressure and forcing said material to be printed into said deformable layer, to cause the pins in contact with the surface through the film to be retracted so that the film is forced to closely contact said surface, and vibrating said straight pins in the axial direction of said pins to print said pattern on said material to be printed.

2. A method of printing in accordance with claim 1, wherein said vibrating is carried out by means of an ultrasonic oscillator, said oscillator also performing said heating of said deformable layer.

3. A method of printing in accordance with claim 1, wherein said contacting of said melted film with said material to be printed is such that said pattern on said printing film contacts said material to be printed.

4. A method of printing a material to be printed, which comprises:

providing a deformable layer of an assemblage of straight pins arranged parallel to each other to form an impression surface at one end of said assemblage, said pins being provided in a density to exert pressure on a water-expandable film when said film is placed in contact with said impression surface of said deformable layer, placing said water-expandable film, having a pattern printed on said film, in contact with said impression surface of said deformable layer, applying water to said film to cause said film to absorb water and become extended over said impression surface, removing excess water from said film, and contacting said extended film with a surface of the said material to be printed under pressure and forcing said material to be printed into said deformable layer, to cause the pins in contact with the surface through the film to be retracted so that the film is forced to closely contact said surface.

5. A method of printing in accordance with claim 1 or 4, wherein said pressure is provided by imparting a resistant force to said deformable layer against engagement of said material to be printed with said deformable layer.

6. A method of printing in accordance with claim 1 or 4, wherein a profile member which closely fits the surface of said material to be printed is provided at the end of said deformable layer opposite said impression surface to force said deformable layer toward said material to be printed until said impression surface completely engages the surface of said material to be printed.

7. A method of printing in accordance with claim 5, wherein said resistant force of the deformable layer is obtained from interactive friction of said straight pins.

8. A method of printing in accordance with claim 5, wherein said resistant force of the deformable layer is given by an elastic film provided on the end of said deformable layer opposite said impression surface.

9. A method of printing in accordance with claim 5, wherein said resistant force of the deformable layer is given by a cushion layer provided at the end of said deformable layer opposite said impression surface.

10. A method of printing in accordance with claim 1 or 4, wherein the deformable layer moves toward said material to be printed so that the surface of said material to be printed is taken into the deformable layer.

11. A method of printing in accordance with claim 10, wherein said deformable layer is moved by applying compressed air to the end of the deformable layer opposite said impression surface.

* * * * *